US006731866B2

(12) United States Patent
Ueno

(10) Patent No.: US 6,731,866 B2
(45) Date of Patent: May 4, 2004

(54) REPAIR DEVICE FOR VEHICLE

(75) Inventor: Makoto Ueno, Tagajo (JP)

(73) Assignee: Tateo Uegaki, Senda (JP)

( * ) Notice: Subject to any disclaimer, the term of this patent is extended or adjusted under 35 U.S.C. 154(b) by 0 days.

(21) Appl. No.: 10/297,375

(22) PCT Filed: Jun. 5, 2001

(86) PCT No.: PCT/JP01/04745

§ 371 (c)(1),
(2), (4) Date: Dec. 4, 2002

(87) PCT Pub. No.: WO01/94167

PCT Pub. Date: Dec. 13, 2001

(65) Prior Publication Data

US 2003/0132223 A1 Jul. 17, 2003

(30) Foreign Application Priority Data

Jun. 6, 2000 (JP) ..... 2000-169679

(51) Int. Cl.[7] ..... F26B 3/30

(52) U.S. Cl. ..... 392/415; 392/412; 34/268; 34/270; 34/275

(58) Field of Search ..... 392/415, 412–413, 392/418; 34/266, 268, 269, 270, 275

(56) References Cited

U.S. PATENT DOCUMENTS 4,662,086 A * 5/1987 Hennecke et al. ..... 34/229
6,077,350 A * 6/2000 Morton et al. ..... 118/712

FOREIGN PATENT DOCUMENTS

| | | | |
|---|---|---|---|
| DE | 3842532 | * | 6/1990 |
| EP | 851193 | * | 7/1998 |
| FR | 2416059 | * | 10/1979 |
| FR | 2695196 | * | 3/1994 |
| GB | 2306210 | * | 4/1997 |
| JP | 4-48967 | * | 2/1992 |
| JP | 08-182957 | | 7/1996 |
| JP | 08-334320 | | 12/1996 |
| JP | 11-132946 | | 5/1999 |
| JP | 2000-111490 | | 4/2000 |
| JP | 2002-52359 | * | 2/2002 |
| WO | 96/07489 | * | 3/1996 |

* cited by examiner

*Primary Examiner*—John A. Jeffery
(74) *Attorney, Agent, or Firm*—Burr & Brown

(57) ABSTRACT

An object of the present invention is to provide a repair device for vehicle capable of reducing the labor of an operator in paint and putty drying operation, facilitating the operation of the device, and providing a high quality paint surface. The repair device of the present invention includes a drying apparatus for drying a coating material coated on a panel surface, a distance detection sensor installed in the drying apparatus and detecting a distance between the drying apparatus and the panel surface coated with the coating material, and a moving device for moving the drying apparatus along the panel surface. The moving device moves the drying apparatus along the panel surface so that a value detected by the distance detection sensor comes within a specified range.

16 Claims, 17 Drawing Sheets

REPAIR DEVICE FOR VEHICLE

TECHNICAL FIELD

The present invention relates to a repair device for a vehicle, and more specifically, to a repair device to be used when drying paint, putty or the like applied to a panel surface.

BACKGROUND ART

In an example of a repair device for a vehicle to be used when drying paint, putty, etc. applied to a panel surface of a vehicle or the like, the panel surface is irradiated with infrared rays to dry the paint. This conventional repair device for a vehicle is equipped with a drying apparatus having a plurality of infrared-ray irradiation devices, and a support rack for supporting the drying apparatus at a predetermined angle and height with respect to the panel surface. The support rack has a support block capable of supporting the drying apparatus at a desired angle, a column on which the support block is provided so as to be vertically slidable, and a leg portion provided at the lower end of the column. The operator is enabled to change the fixation angle and height of the drying apparatus on the support rack, making it possible to fix the drying apparatus at an arbitrary position.

Further, after the application of paint to the panel surface, the drying apparatus provided in the repair device for a vehicle is installed in close proximity of the panel surface, and infrared rays are applied thereto. The infrared rays irradiation dine is appropriately changed according to the kind of paint and the thickness of the paint film. Further, the irradiation distance is varied according to the surface configuration of the panel surface to which the paint has been applied, for example, the inclination angle of the panel surface. Then, after determining the infrared rays irradiation distance depending on the intuition and experience of the operator, infrared rays are irradiated. Further, the operator makes a judgment as to whether the paint has been dried or not on the basis of his intuition and experience, stopping the infrared irradiation when be determines that the paint has been dried.

In the above-described conventional drying apparatus, the operations from the installation of the drying apparatus to the control of the irradiation time are left to the operator, which means a great burden for the operator.

Further, as stated above, the control of the irradiation time mostly depends on the intuition and experience of the operator. Thus, when an operator with little experience operates the drying apparatus, it can happen that the application of infrared rays is stopped before the coating material applied to the panel surface has been completely dried, thereby impairing the quality of the paint surface.

Further, in setting the infrared rays irradiation distance, it is necessary to appropriately adjust the angle and height of the drying apparatus with respect to the panel surface so that the panel surface may be uniformly irradiated with the infrared rays. However, the panel surface is not always flat; it may consist of a plurality of planes as in the case of a portion around a taillight. Thus, when a person inexperienced in the operation of the drying apparatus installs the drying apparatus, there will be generated unevenness in the irradiation of the panel surface with infrared rays, resulting in an unstable paint surface quality.

It is accordingly an object of the present invention to provide a repair device for a vehicle capable of reducing the labor of the operator in the operation of drying paint, putty or the like. Further, the present invention aims to provide a repair device for a vehicle that is easy to operate and provides a high quality paint surface.

SUMMARY OF THE INVENTION

A repair device for a vehicle according to the present invention includes a drying apparatus for drying a coating material applied to a panel surface, a distance detection sensor provided on the drying apparatus and adapted to detect the distance from the drying apparatus to the panel surface to which the coating material is applied, and a moving device for moving the drying apparatus along the panel surface. The moving device moves the drying apparatus along the panel surface such that the value detected by the distance detection sensor is a value within a predetermined range.

In this way, in the repair device for a vehicle of the present invention, there is provided a moving device supporting the drying apparatus always at a fixed distance from the panel surface coated with the coating material, so that the coating material is always dried under a fixed condition. That is, even if an operator with little experience handles the vehicle repair device, it is possible to obtain a dried surface with good quality. Further, the drying apparatus is automatically installed at a position allowing efficient drying of the coating material applied to the panel surface, thereby substantially reducing the labor of the operator. Here, the coating material applied to the panel surface consists of a material which cures by being dried, such as a paint, putty or the like.

A repair device for a vehicle according to the present invention may further include a drying apparatus for drying a coating material applied to a panel surface, a dryness detection sensor for detecting the dryness of the coating material applied to the panel surface, and a moving device for moving the drying apparatus to another region of the panel surface when it is determined by to dryness detection sensor that the panel surface is dry.

That is, when drying the coating material applied to the panel surface, the drying apparatus is moved while checking the drying state of the coating material, so that the coating material is reliably dried. Thus, even if an operator with little experience handles the vehicle repair device, it is possible to obtain a dried surface with good quality. Further, upon drying of the coating material, the position of the drying apparatus with respect to the panel surface is automatically changed, so that there is no need to control the requisite time for drying, thereby reducing the labor of the operator.

Note that, a repair device for a vehicle according to the present invention may have a structure such that: the moving device includes a longitudinal frame, a lateral frame provided so as to be slidable in the vertical direction of the longitudinal frame, and an arm frame which is provided so as to be slidable in the axial direction of the lateral frame and in a direction perpendicular to the axial direction and which is supported so as to be rotatable in the vertical direction thereof using the lateral frame as a rotation axis; and the drying apparatus is provided at the distal end of the arm frame so as to be at a desired angle. That is, the moving device supporting the drying apparatus includes a plurality of movable portions, and moves the drying apparatus along the panel surface by moving the plurality of movable portions.

The drying apparatus may be equipped with an infrared-ray irradiation device for applying infrared rays to the coating material applied to the panel surface, and a blower for blowing air warmed by the infrared rays from the infrared-ray irradiation device toward the coating material applied to the panel surface. In the drying apparatus of this construction, it is possible to apply infrared rays directly to the coating material applied to the panel surface, so that the drying of the coating material is expedited by the radiation heat of the infrared rays. Further, the air warmed by the infrared rays, that is, warm air, is blown against the coating material, and due to the resultant synergistic effect, the coating material can be dried in a shorter time. In warming the air blown by the blower, it is also possible to provide a dedicated infrared-ray radiation device for the blower.

The distance detection sensor may have an oscillating portion emitting an ultrasonic wave, a receiving portion for receiving the ultrasonic wave from the oscillating portion, and a conversion processing portion for measuring the time it takes for the ultrasonic wave from the oscillating portion to reach the receiving portion and converting the time to a distance. That is, it is possible to adopt an ultrasonic distance measuring sensor or the like. Of course, the distance detection sensor of the present invention is not restricted to the ultrasonic distance measuring sensor. Any type of sensor will do as long as it is capable of measuring the distance between the panel surface coated with the coating material and the drying apparatus.

The drying state detection sensor preferably consists of a sensor which recognizes the drying state of the coating material by detecting the solvent volatilized into the air from the coating material at the time of drying of the coating material. For example, it is possible to adopt a gas sensor which determines that the dried state has been attained when the amount (concentration) of solvent contained in the air has become a predetermined value or less. Apart from the sensor which recognizes the dried state by detecting the volatilized solvent, it is also possible to adopt, for example, a sensor which recognizes the dried state by monitoring the temperature of the panel surface. That is, any type of sensor will do as long as it is capable of recognizing the dried state.

Further, the drying apparatus may be equipped with an ultraviolet-ray irradiation device which applies ultraviolet rays to the coating material applied to the panel surface. In this case, it is possible to dry a putty, paint or the like containing an ultraviolet polymerization composition that cures upon absorbing ultraviolet rays. It is also possible to adopt a construction in which the drying apparatus consists of the ultraviolet-ray irradiation device only.

Thus, as described above in accordance with the present invention, it is possible to provide a repair device for vehicle capable of reducing the labor of the operator in paint and putty drying operation. Further, it is possible to provide a repair device for vehicle which is easy to handle and which provides a high quality paint surface.

BEST MODE FOR CARRYING OUT THE INVENTION

Hereinafter, a preferred embodiment of the repair device for vehicle of the present invention will be described with reference to the drawings.

First, a repair device for vehicle according to this embodiment will be schematically described.

Figure 1:
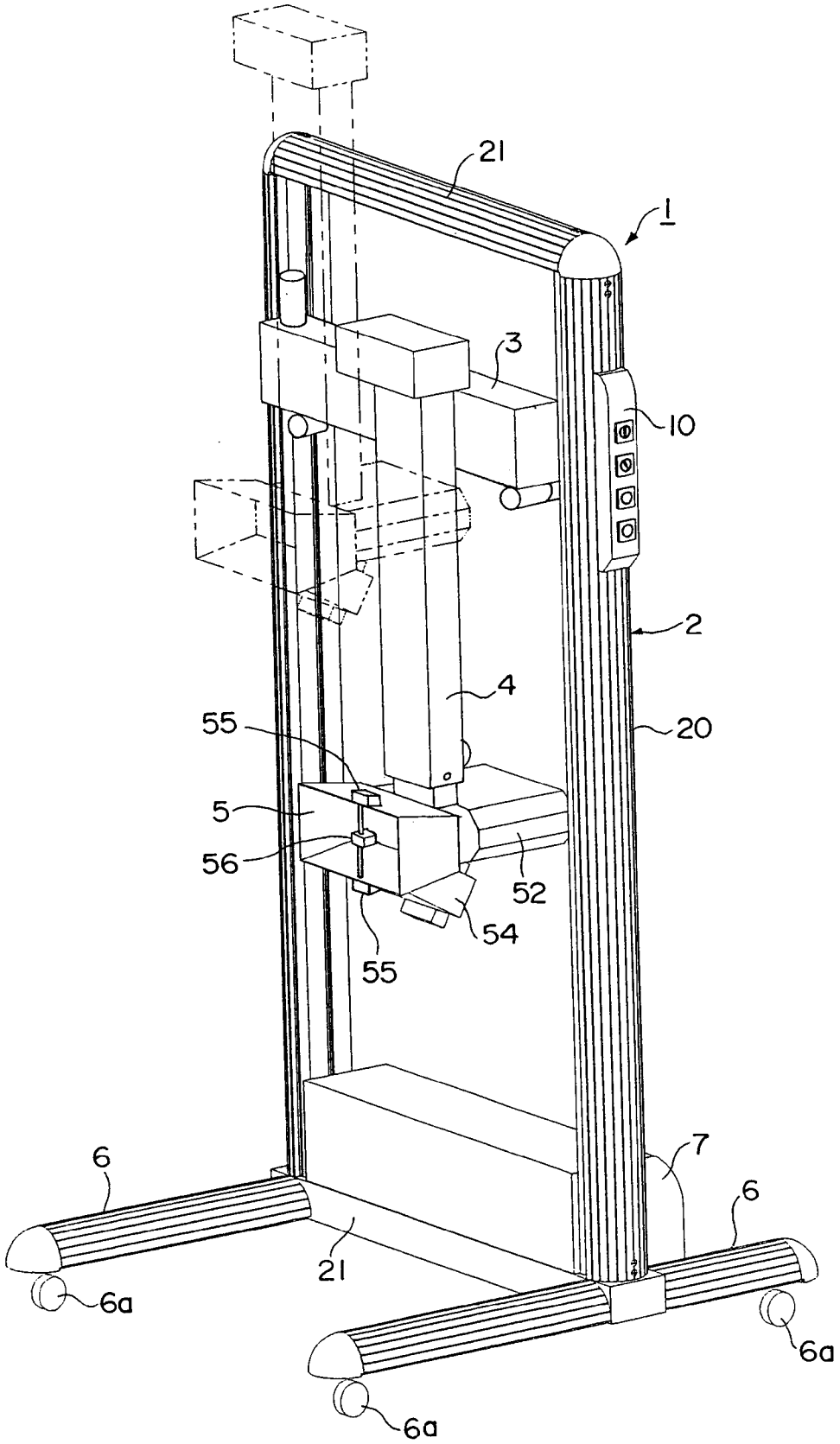
FIG. 1 is a perspective view of a repair device for vehicle according to an embodiment of the present invention.
Figure 2:
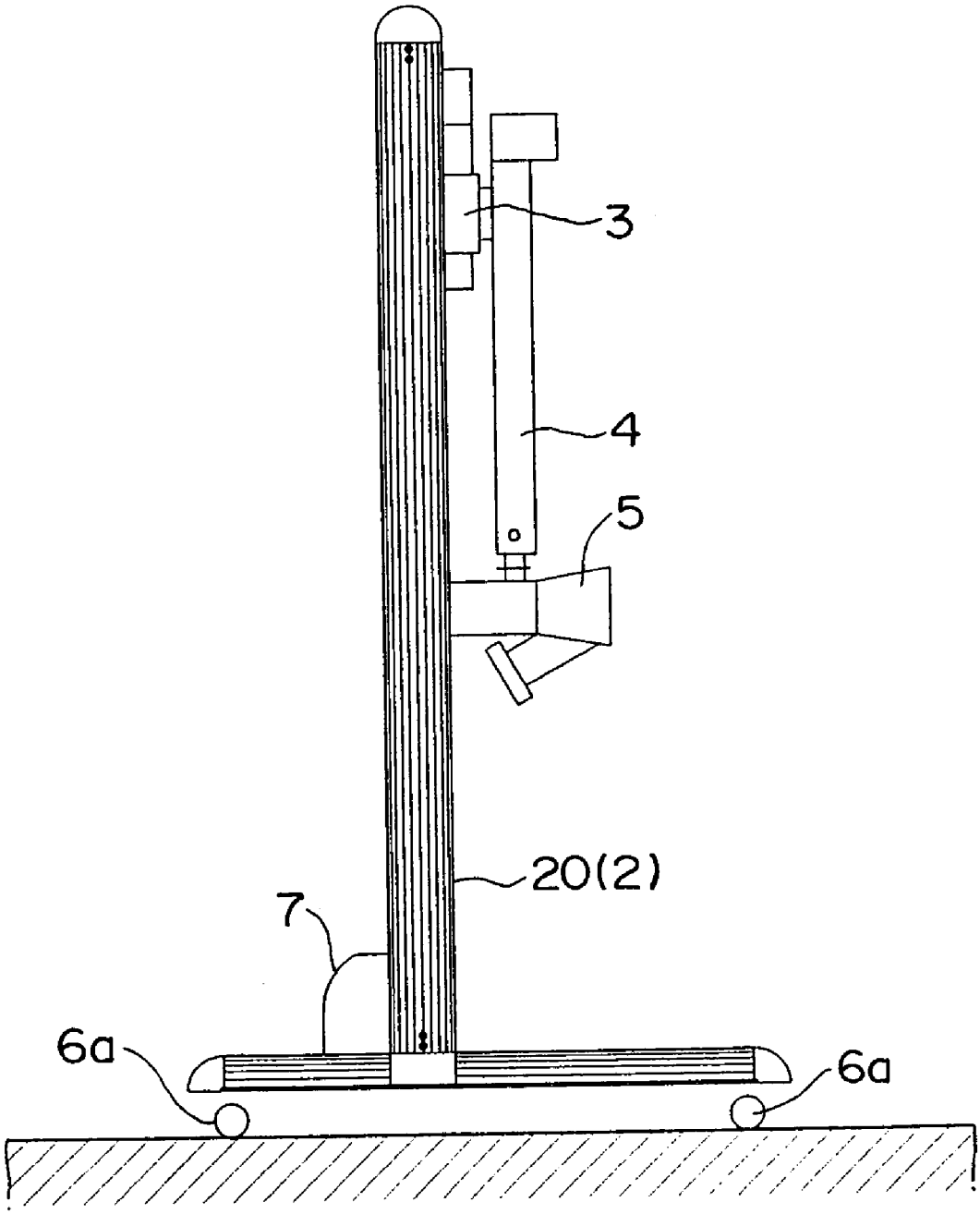
FIG. 2 is a side view of a repair device for vehicle according to an embodiment of the present invention.
Figure 3:
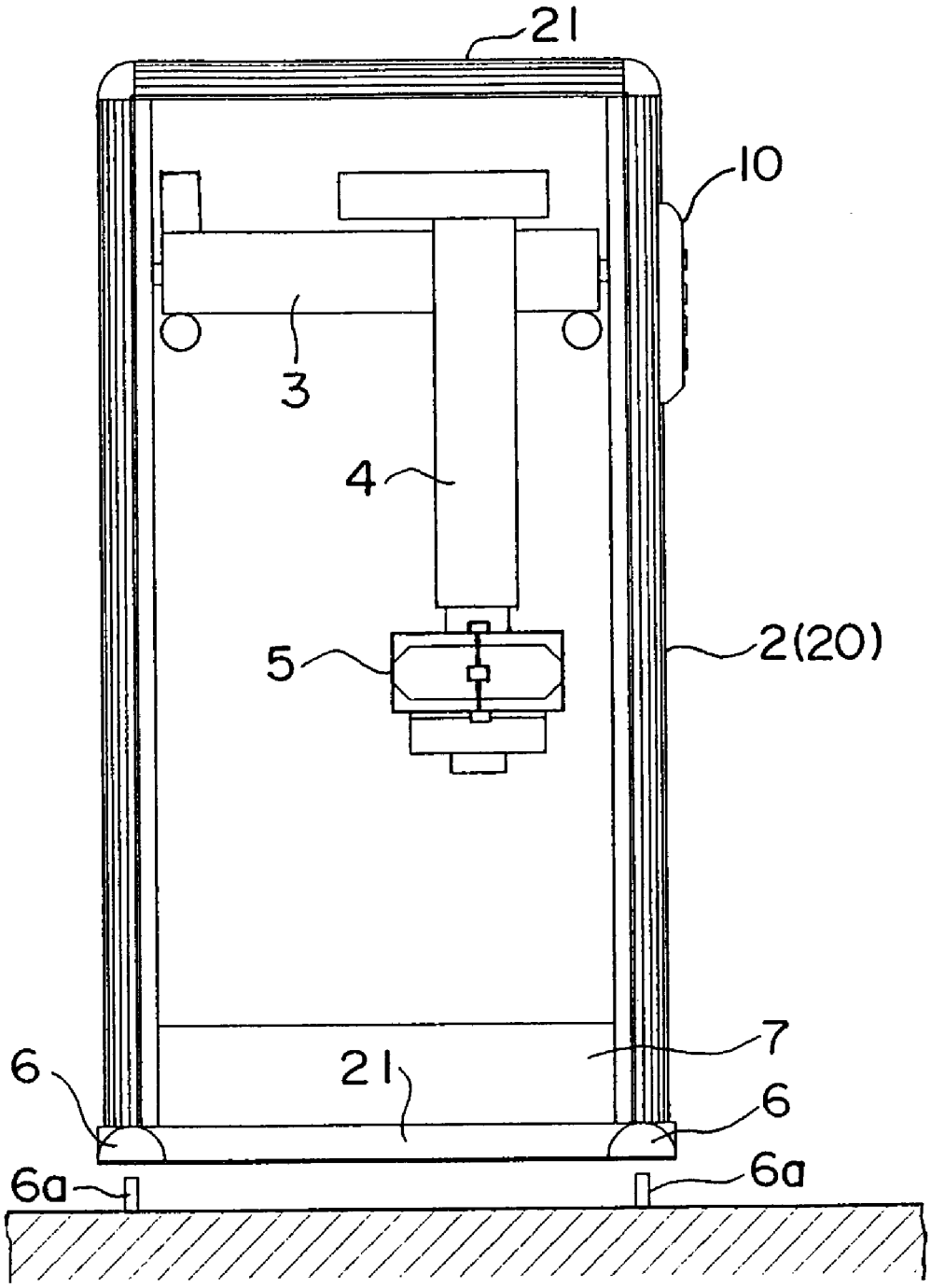
FIG. 3 is a front view of a repair device for vehicle according to an embodiment of the present invention.

As shown in FIG. 1, the repair device for vehicle is equipped with a support rack 1. This support rack 1 has a longitudinal frame 2 formed in a framework-like shape, and a lateral frame 3 provided so as to extend across the longitudinal frame 2 and capable of sliding in the vertical direction thereof. Further, the support rack 1 has an arm frame 4 which is provided so as to be perpendicular to the lateral frame 3, which is capable of sliding in the axial direction of the lateral frame 3 and in a direction perpendicular thereto, and which is vertically rotatable around the lateral frame 3. And, at the distal end of the arm frame 4, a drying apparatus 5 for drying a coating material applied to a panel surface of a vehicle is provided so as to allow adjustment of its angle.

Further, at the lower end side of the longitudinal frame 2, there are provided two base frames 6, through the intermediation of which the longitudinal frame 2 is installed in a stable manner on a floor constituting the operation site. The base frames 6 are provided with a plurality of wheels (casters) 6*a*, by means of which the support rack 1 can be easily moved on the floor constituting the operation site. Further, provided in the lower portion of the support rack 1 is a control box 7 containing a control board for controlling the drying apparatus 5 and movable portions of the support rack 1. And, by means of control signals from the control board provided in the control box 7 and generated on the basis of various conditions, the movable portions of the support rack 1 and the drying apparatus 5 are controlled to dry a paint or the like applied to the panel surface of the vehicle.

In the following, the above-mentioned components will be described in more detail.

The longitudinal frame 2 is composed of two columns 20 arranged upright on the floor constituting the operation site through the intermediation of the base frames 6 and a junction frame 21 connecting the upper end portion of one column 20 to the upper end portion of the other column 20, and is formed as a framework having a large dimension in the height direction. Further, each column 20 is formed as a cylinder containing a slide mechanism composed of a loop-like chain 22, a driving motor 23, etc. (See FIG. 4) And, the lateral frame 3 is arranged so as to extend across the columns 20 having the slide mechanisms.

Figure 4:
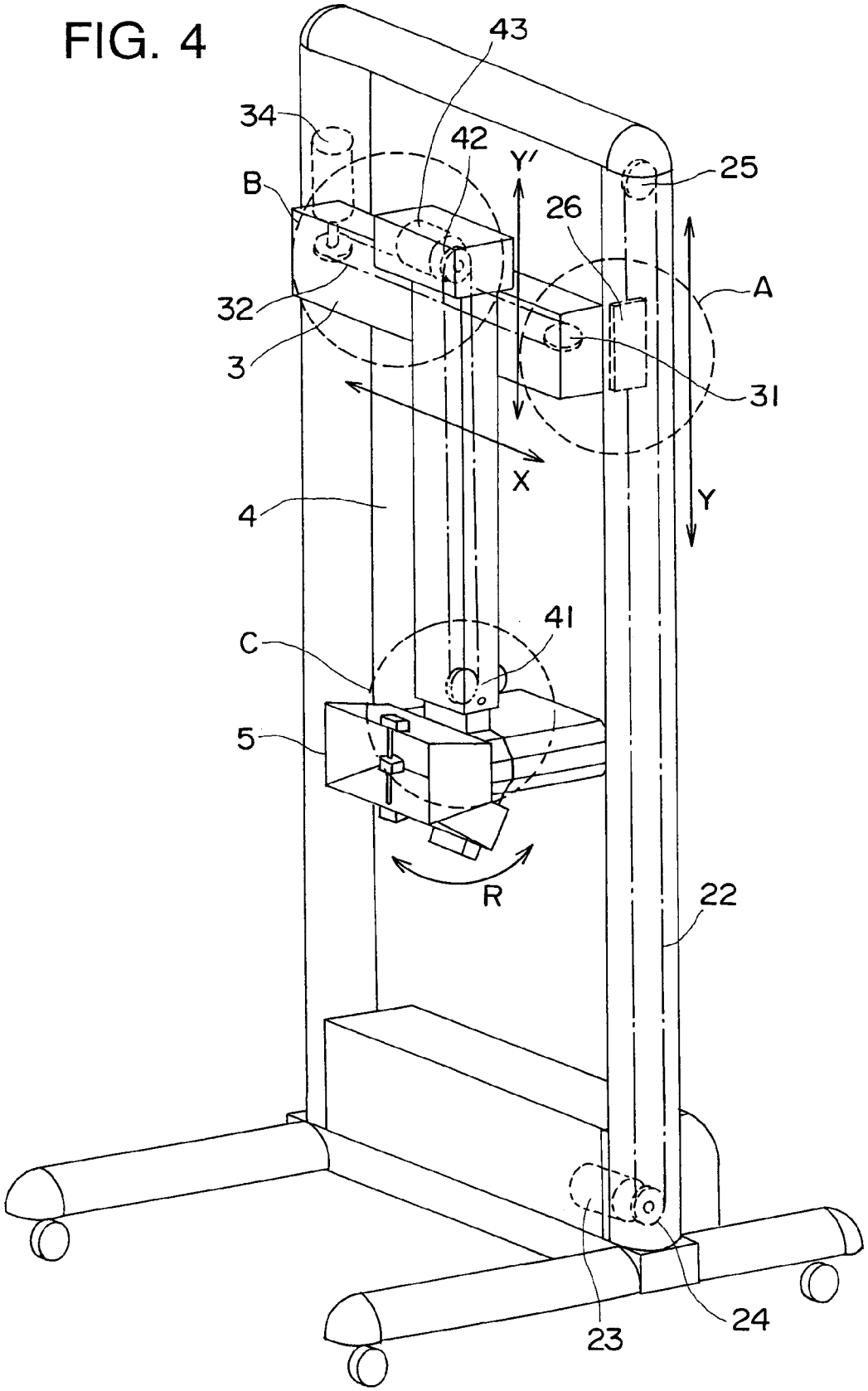
FIG. 4 is a schematic diagram showing a slide mechanism of a repair device for vehicle according to an embodiment of the present invention.
Figure 6:
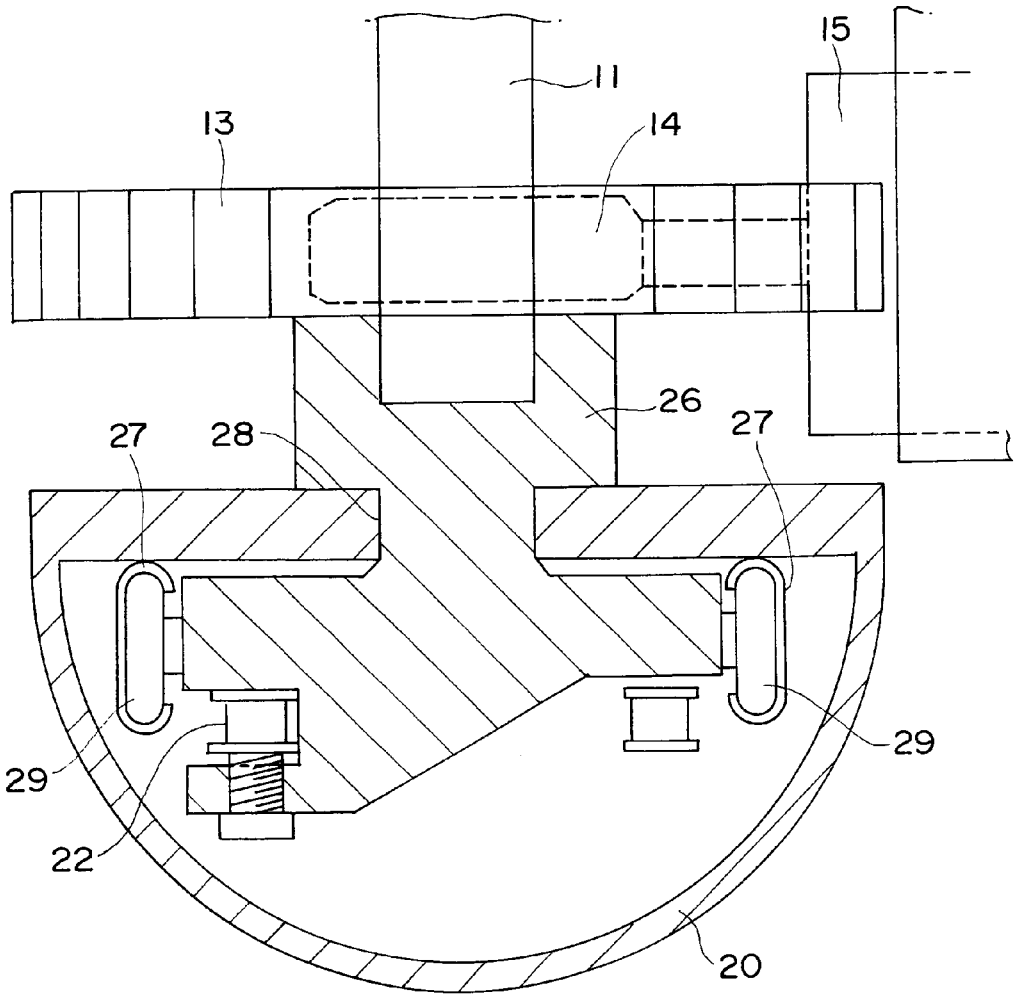
FIG. 6 is an enlarged view of a main portion, showing portion A of FIG. 4.

As shown in FIGS. 4 and 6, the slide mechanism provided in each column 20 has the driving motor 23 provided at the lower end of the column 20, a sprocket 24 provided on the rotation shaft of the driving motor 23, a pulley 25 provided in the top portion of the column 20, the loop-like chain 22 stretched between the sprocket 24 and the pulley 25, and a bracket 26 fixed to one side of the loop-like chain 22, an end portion of the lateral frame 3 being joined to the bracket 26.

Further, provided in each column 20 are guide rails 27 and a slot 28 extending in the vertical direction thereof. And, a part of the bracket 26 extends to the exterior of the column through the slot 28 to support the lateral frame 3. Further, the bracket 26 is equipped with a plurality of rollers 29, which are engaged with the guide rails 27 so as to be capable of rolling. Thus, by taking up the chain 22 through normal or reverse rotation of the sprocket 24 provided on the rotation shaft of the driving motor 23, the bracket 26 moves up and down along the guide rails 27, and the lateral frame 3 held by the brackets 26 slides in the vertical direction (the direction of arrow Y in FIG. 4) of the longitudinal frame 2.

Figure 5:
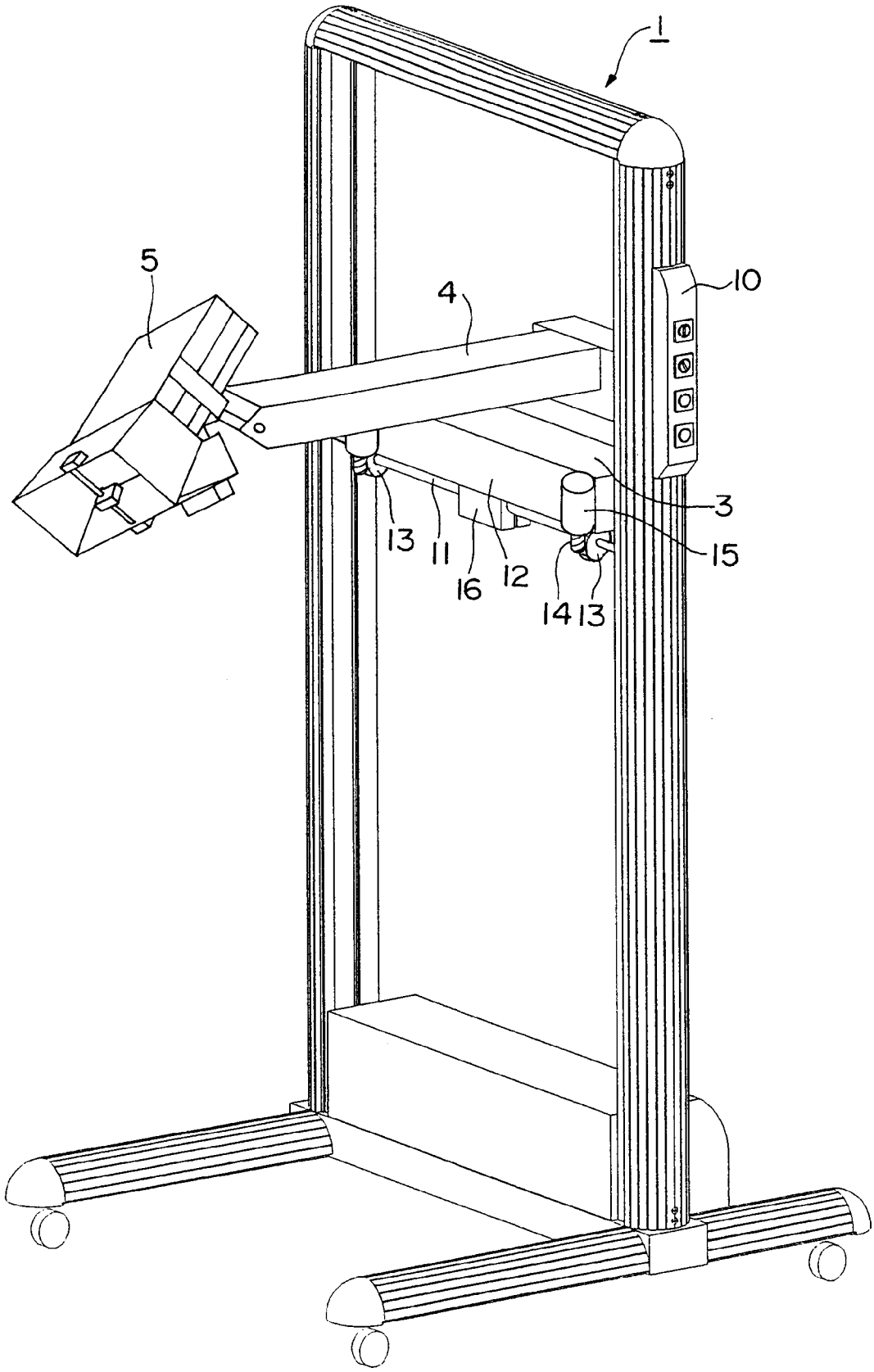
FIG. 5 is a perspective view of a repair device for vehicle, showing how an arm frame is rotated.
Figure 7:
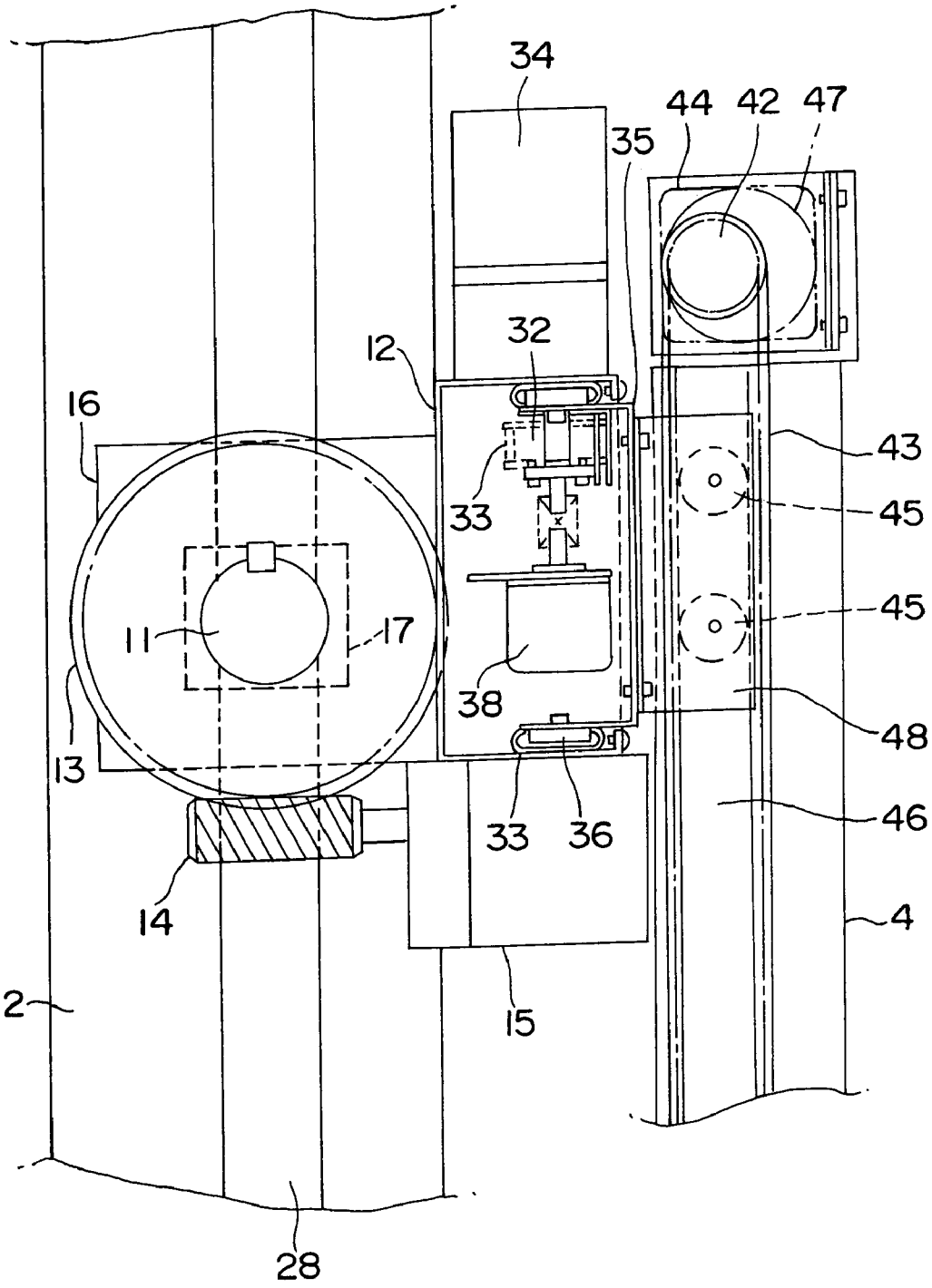
FIG. 7 is an enlarged view of a main portion, showing portion B of FIG. 4.

As shown in FIGS. 5 and 7, the lateral frame 3 is composed of a lateral frame support bar 11 whose ends are fixed to the brackets 26 described above, and a lateral frame main body 12 extending parallel to the lateral frame support bar 11 and rotatable around the lateral frame support bar 11. And, the arm frame 4 is provided on the lateral frame main body 12 so as to be perpendicular thereto.

The mounting structure for mounting the lateral frame main body 12 to the lateral frame support bar 11 is composed of driving motors 15 fixed to the lateral frame main body 12 and a junction block 16 rotatably connecting the frame main body 12 to the lateral frame support bar 11. The driving motors 15 are equipped with fixed gears 13 provided in the vicinity of the ends of the lateral frame support bar 11 and fixed to the lateral frame support bar 11, and worm gears 14 in mesh with the fixed gears 13. And, when the driving motors 15 provided on the lateral frame main body 12 are driven, the lateral frame main body 12 rotates around the axis of the lateral frame support bar 11. That is, when the driving motors 15 are driven, the arm frame 4 is rotated around the lateral frame support bar 11 in the vertical direction thereof (the direction of arrow R in FIG. 4).

Motors containing reduction gears of high reduction ratio are used as the driving motors 15 for rotating the worm gears 14. Further, mounted to the junction block 16 is a rotation angle sensor 17 for detecting the rotation angle of the lateral frame main body 12 with respect to the lateral frame support bar 11. Further, the lateral frame main body 12 is formed as a box having substantially the same length as the lateral frame support bar 11 and contains a slide mechanism for causing the arm frame 4 to slide in the axial direction of the lateral frame main body 12. And, the arm frame 4 is slidably provided on the lateral frame main body 12 through the intermediation of this slide mechanism.

When the slide mechanism provided in the lateral frame main body 12 is driven, the arm frame 4 slides in the axial direction of the lateral frame main body 12 (the direction of arrow X in FIG. 4). Meanwhile, the arm frame 4 is also equipped with a slide mechanism which is substantially the same as that provided in the lateral frame main body 12. When the slide mechanism provided in the arm frame 4 is driven, the arm frame 4 slides in a direction perpendicular to the lateral frame 3 (the direction of arrow Y' in FIG. 4).

Figure 8:
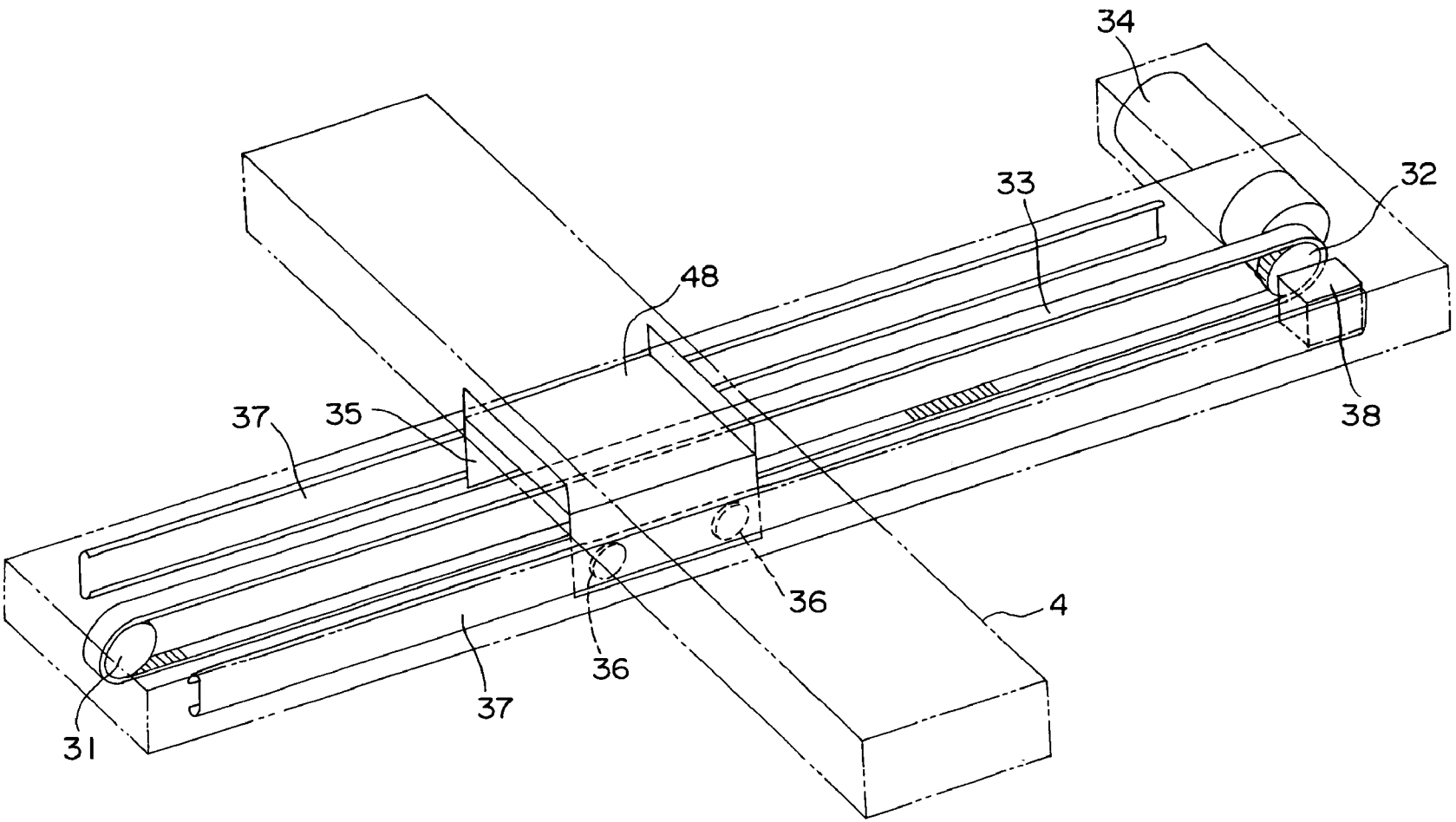
FIG. 8 is a schematic diagram showing a slide mechanism provided in a frame.

In the following, the slide mechanisms provided in the lateral frame main body 12 and the arm frame 4 will be described in more detail with reference to FIGS. 7 through 9. It should be noted that FIG. 8 is a diagram schematically showing the slide mechanism provided in the lateral frame main body 12. Further, FIG. 7 is an enlarged view showing the junction portion connecting the lateral frame main body 12 and the arm frame 4.

First, the slide mechanism provided in the lateral frame main body 12 will be schematically described with reference to FIG. 8. The slide mechanism provided in the lateral frame main body 12 has a guide pulley 31 and a driving pulley 32 provided at the end portions of the lateral frame main body 12, a loop-like belt 33 stretched between the guide pulley 31 and the driving pulley 32, a driving motor 34 provided on the driving pulley 32 and adapted to rotate the pulley 32, and a frame connecting plate 35 fixed to one side of the belt 33 stretched between the pulleys 31 and 32. And, when the driving motor 34 is driven to rotate the belt 33, the frame connecting plate 35 slides in the axial direction of the lateral frame main body 12 together with the belt 33.

The frame connecting plate 35 consists of a U-shaped metal plate with its end portions bent in the same direction, and a plurality of rollers 36 are mounted to each of the bent portions thereof. Further, in addition to the above-mentioned components, provided inside the lateral frame main body 12 are two guide rails 37 extending in the longitudinal direction thereof. And, the rollers 36 provided on the frame connecting plate 35 are engaged with the guide rails 37 so as to be capable of rolling. Thus, when the frame connecting plate 35 moves, it moves along the guide rails 37.

Further, mounted to the driving pulley 32 is a rotation angle sensor 38 for detecting the rotation angle of the driving pulley 32. From the value detected by the rotation angle sensor 38, it is possible to detect the moving amount of the frame connecting plate 35 with respect to the lateral frame main body 12. That is, the rotation angle of the driving pulley 32 detected by the rotation angle sensor 38 is fed back to control the rotation of the driving motor 34, whereby it is possible to slide the frame connecting plate 35 to a desired position.

The driving motor 34 consists of a motor with large driving force containing a reduction gear. Further, the driving pulley 32 and the belt 33 have teeth to be engaged with each other. Thus, the rotation of the driving motor 34 is accurately transmitted to the belt 33 through the driving pulley 32.

Meanwhile, the slide mechanism provided in the arm frame 4 has also the same construction as that of the slide mechanism provided in the lateral frame main body 12. As shown in FIGS. 7 and 9, the slide mechanism provided in the arm frame 4 has a guide pulley 41 and a driving pulley 42 which are provided at the end portions of the arm frame 4, a belt 43 stretched between the guide pulley 41 and the driving pulley 42, a driving motor 47 for rotating the driving pulley 42, a rotation angle sensor 44 connected to the driving pulley 42 and adapted to detect the rotation angle of the pulley 42, a frame connecting plate 48 fixed to one side of the belt 43, two guide rails 46 extending in the axial direction of the arm frame 4, and rollers 45 engaged with the guide rails 46 so as to be capable of rolling. And, the slide mechanism feeds back the value detected by the rotation angle sensor 44 to control the driving motor 43, whereby it is possible to slide the frame connecting plate 48 to a desired position.

Then, by means of the frame connecting plates 35 and 48, the lateral frame main body 12 and the arm frame 4 are connected so as to be perpendicular to each other. That is, when the frame connecting plate 48 provided on the arm frame 4 side is connected to the frame connecting plate 35 provided on the lateral frame main body 12 side in a state in which it has been turned by 90 degrees, it is possible to slide the arm frame 4 in the axial direction of the lateral frame main body 12 (lateral frame 3) and in a direction perpendicular thereto. It should be noted that the control of the driving motors 34 and 47 related to the sliding of the frames 3 and 4 will be described in detail along with the control of the drying apparatus 5 described below.

In this way, the arm frame 4 is provided so as to be slidable in the axial direction of the lateral frame 3 and in the direction perpendicular thereto. And, the drying apparatus 5 for drying paint or the like applied to a vehicle panel surface is rotatably mounted to the distal end portion of the arm frame 4. In the following description, the panel surface to which paint is applied will be simply referred to as the panel surface or the paint surface.

The drying apparatus 5 has a casing 51 formed as a rectangular box having an opening 51*a* at one end, an infrared-ray irradiation portion 52 provided in the casing 51 and adapted to irradiate infrared rays to the panel surface, a blower 53 mounted to a side wall surface of the casing 51 and adapted to blow air warmed by the infrared-ray irradiation portion 52 toward the panel surface from the opening 51*a* of the casing 51, and an ultraviolet-ray irradiation portion 54 provided by the side of the casing 51 and adapted to irradiate ultraviolet rays to the panel surface from the opening 51*a* of the casing 51.

Provided in the infrared-ray irradiation portion 52 is an IR (infrared ray) heater 52*a* for emitting mid-infrared rays. Further, provided in the ultraviolet-ray irradiation portion 54 is a UV lamp 54*a* having a spectral energy peak near a wavelength of 410 nm.

Further, the drying apparatus 5 is equipped with a distance detection sensor 55 for detecting the distance from the paint surface to the drying apparatus 5, and a dryness detection sensor 56 for detecting the dryness of the paint surface. This embodiment uses as the distance detection sensor 55 an ultrasonic distance measuring sensor having an oscillating portion for emitting a predetermined number of ultrasonic waves, a receiving portion for receiving the ultrasonic waves emitted from the oscillating portion and reflected by the panel surface, and a conversion processing portion for measuring the time required for the ultrasonic waves emitted from the oscillating portion to reach the receiving portion and converting the time into a distance. As shown in FIG. 9, a plurality of such distance detection sensors are provided along the periphery of the opening of the casing 51. More specifically, as shown in FIG. 10, they are mounted at two positions in the opening: upper and lower positions matched with the axis of the arm frame 4. It should be noted that the above-mentioned conversion processing portion is contained in the control box 7 mounted to the lower portion of the longitudinal frame 1. Further, the mounting positions and the number of distance detection sensors 55 are not restricted to those of the above-described example.

As the dryness detection sensor 56, a gas sensor is adopted which detects solvent vaporized when the coating material is dried to recognize the dryness of the paint surface. More specifically, the amount of solvent (concentration) in the air is detected by utilizing the change in the electrical resistance of the sensor caused by adhesion to the sensor surface of vaporized alcohol or the like contained in the paint, putty or the like as solvent. And, it is determined that the dried state is attained when the amount (concentration) of solvent contained in the air has reached a level of not more than a predetermined value.

Figure 9:
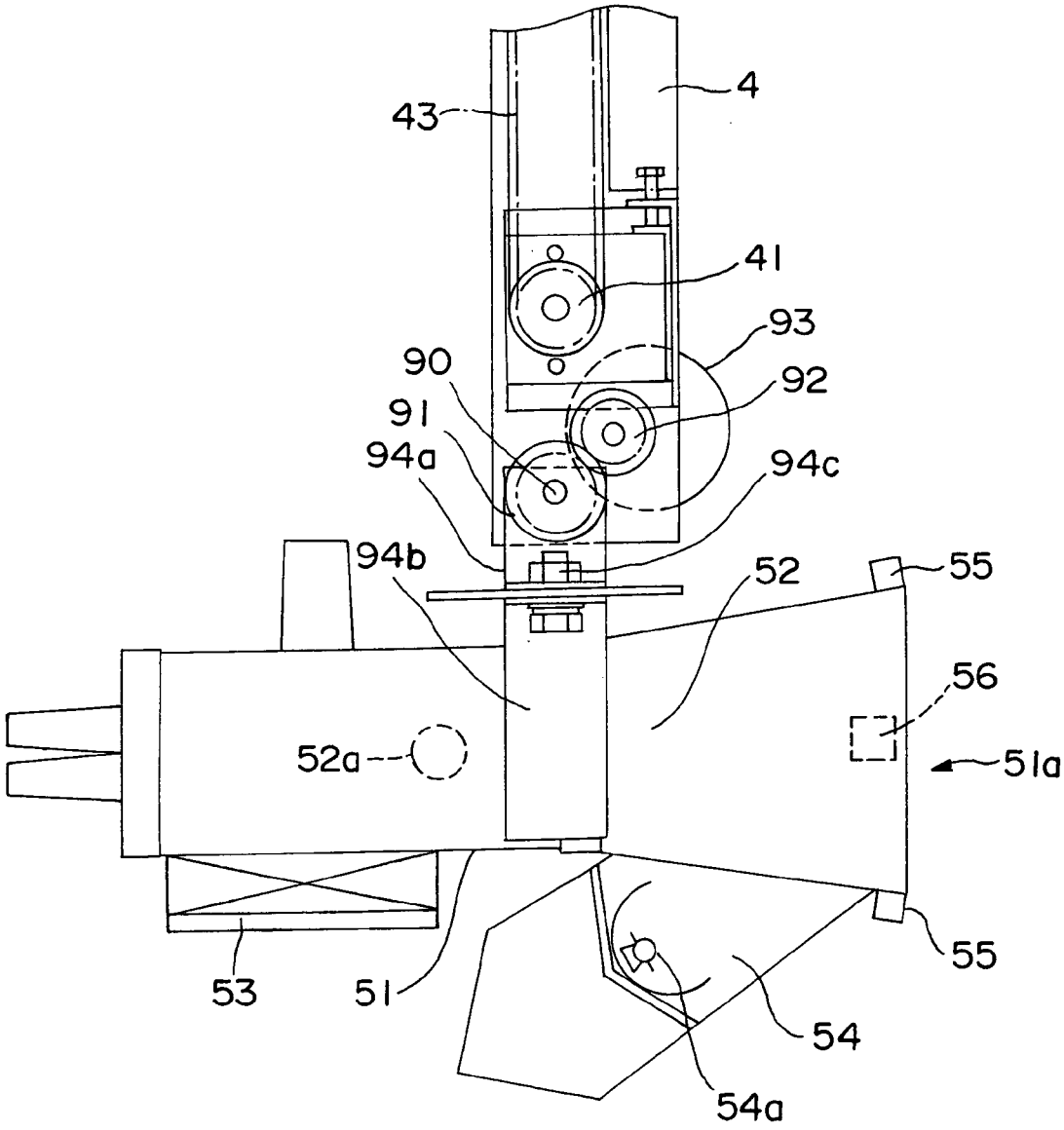
FIG. 9 is an enlarged view of a main portion, showing a movable portion in portion C of FIG. 4 as seen form the side of an arm frame.
Figure 10:
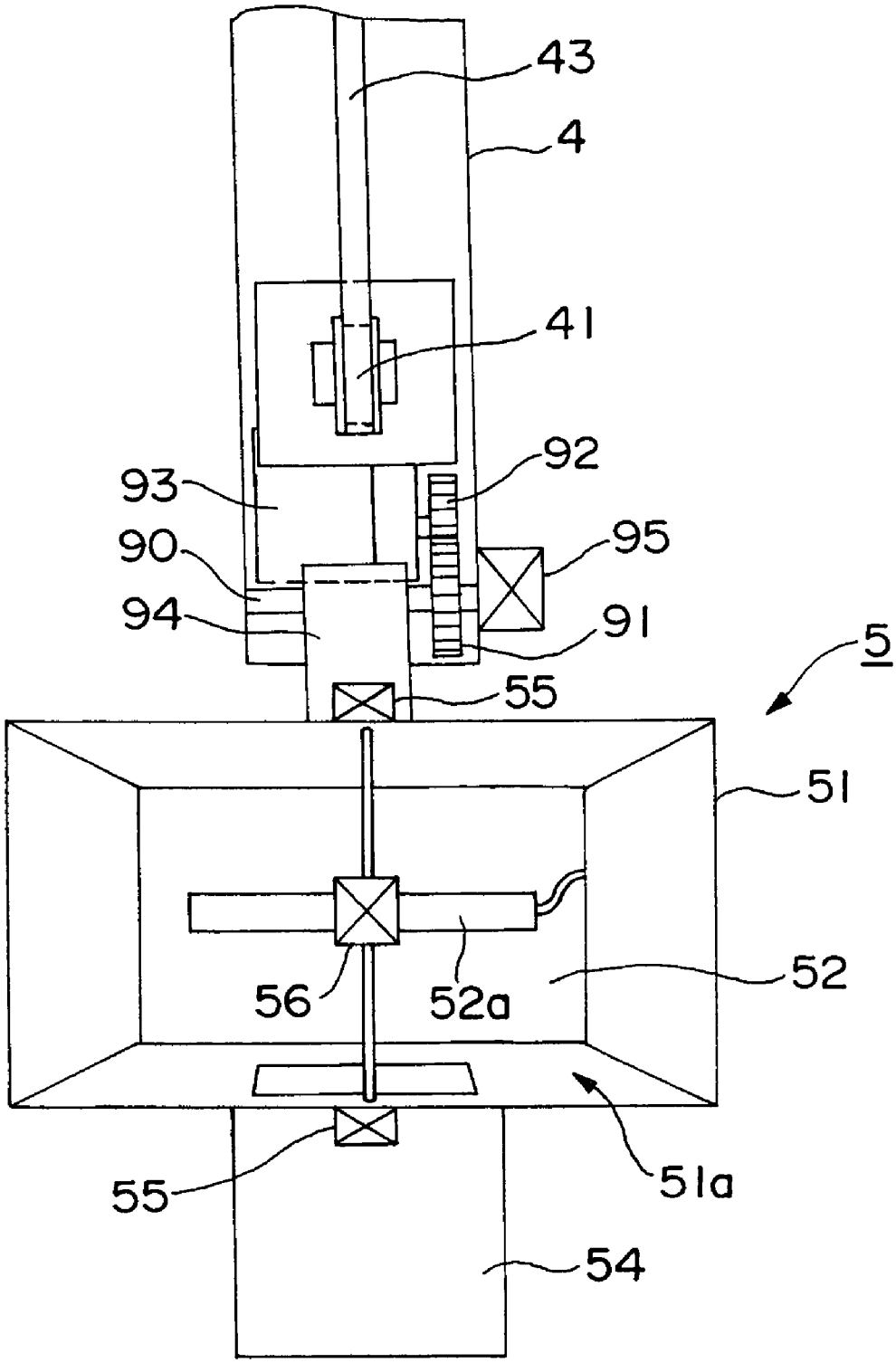
FIG. 10 is an enlarged view of a main portion, showing the movable portion in portion C of FIG. 4 as seen form the front side of the arm frame.

Further, as shown in FIGS. 9 and 10, the mounting structure for mounting the drying apparatus 5 to the arm frame 4 has a rotation shaft 90 provided at the distal end portion of the arm frame 4, a reduction gear 91 provided at an end portion of the rotation shaft 90, a driving motor 93 equipped with a pinion gear 92 in mesh with the reduction gear 91, and a stay 94 fixed to the rotation shaft 90 and adapted to rotate with the rotation of the rotation shaft 90, the drying apparatus 5 being fixed to the stay 94. Thus, by causing the driving motor 93 to perform normal or reverse rotation, it is possible to change the fixing angle of the drying apparatus 5 with respect to the arm frame 4. Moreover, the rotation shaft 90 is equipped with a rotation angle sensor 95 for detecting the inclination angle (position) of the drying apparatus 5 with respect to the arm frame 4. By feeding back the value obtained by this rotation angle sensor 95, it is possible to change the inclination angle of the drying apparatus 5 with respect to the arm frame 4 to a desired inclination angle.

Further, the drying apparatus 5 is also mounted so as to be rotatable with respect to the stay 94 itself. As shown in FIG. 9, the stay 94 is composed of a stay main body 94*a* fixed to the rotation shaft 90 provided in the arm frame 4 and an arm portion 94*b* connected to the drying apparatus 5. Provided at the distal end of the stay main body 94*a* is a connection bolt 94*c* constituting the rotation center for the drying apparatus 5 on the stay 94. And, the arm portion 94*b* is rotatably mounted to the connection bolt 94*c*. That is, the arm portion 94*b* is provided so as to be rotatable around the axis of the arm frame 4. Thus, the drying apparatus 5 is provided so as to be at a desired angle with respect to the arm frame 4. It should be noted that while in this embodiment no movable device consisting of a driving motor or the like is provided for the rotation of the drying apparatus 5 with respect to the stay 94, it is naturally possible to control the rotation by mounting a movable device consisting of a driving motor, rotation angle sensor, etc.

In this way, the drying apparatus is supported by the support rack 1 having a plurality of movable portions. While each movable portion can be arbitrarily moved through manual control (manual mode), it is usually controlled through automatic control (automatic mode) based on the values obtained by the distance detection sensors 55 and the dryness detection sensor 56 provided on the drying apparatus 5. Note that there is provided on a side of the longitudinal frame 2 an operating portion 10 equipped with a control mode changing switch for switching between the manual control and the automatic control, an operating switch for individually moving each movable portion in the manual control mode, etc. By means of this operating portion 10, it is possible to effect mode switching and move each movable portion.

It should be noted that the automatic control refers to a control for moving the drying apparatus 5 on the basis of the value obtained by the distance detection sensors 55 so as to constantly maintain the drying apparatus 5 at a fixed distance from and a fixed angle with respect to the panel surface, and a control for moving the drying apparatus 5 to another region when it is determined on the basis of the value obtained by the dryness detection sensor 56 that the paint surface is in a dried state. Here, the term another region refers to a portion of the paint surface which has not been dried yet.

Figure 11:
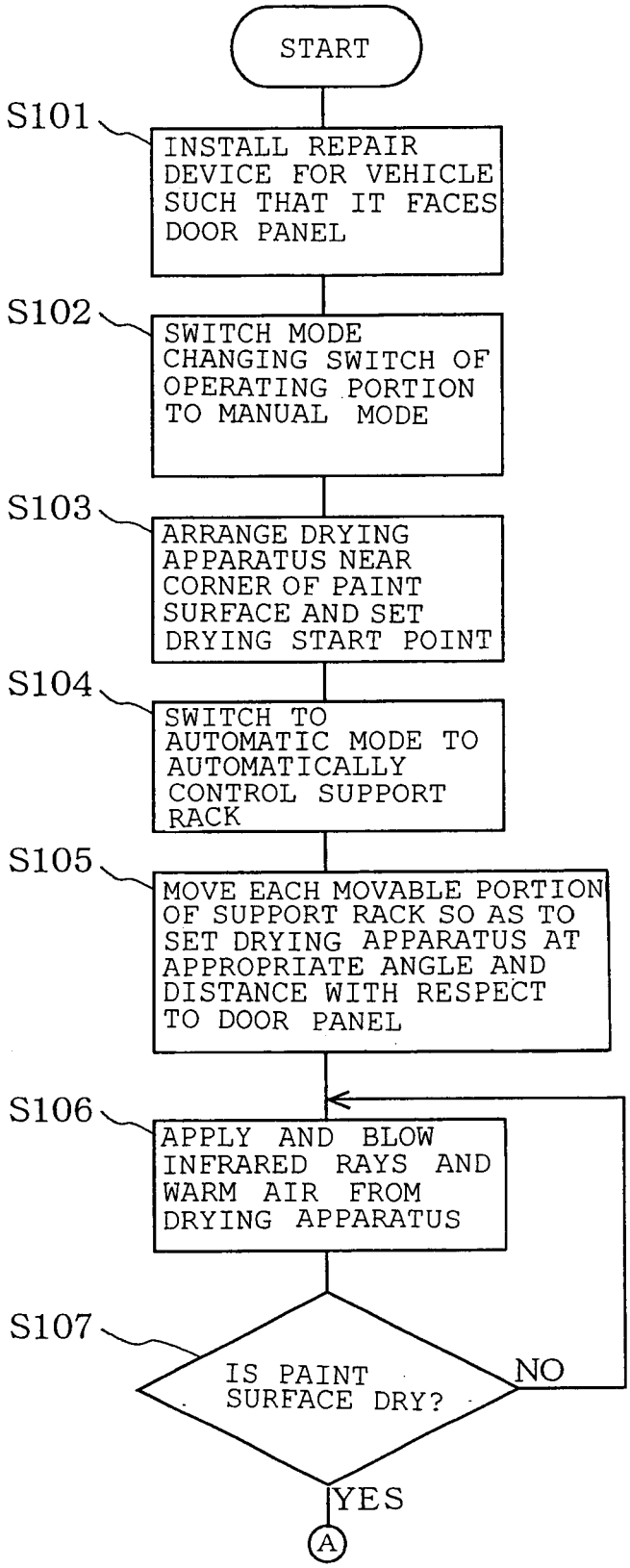
FIG. 11 is a flowchart illustrating a drying operation using a repair device for vehicle.
Figure 12:
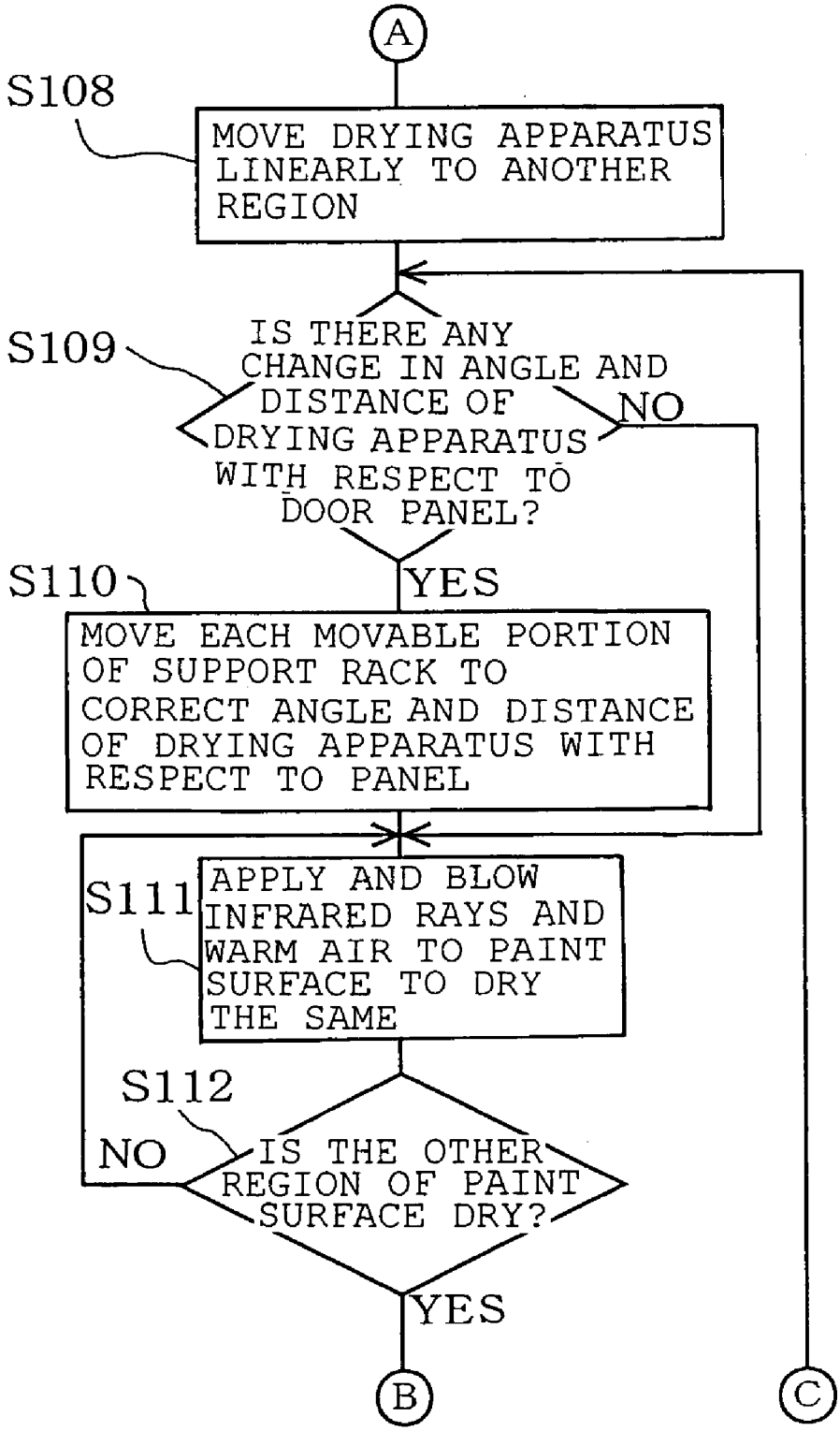
FIG. 12 is a flowchart illustrating a drying operation using a repair device for vehicle.
Figure 13:
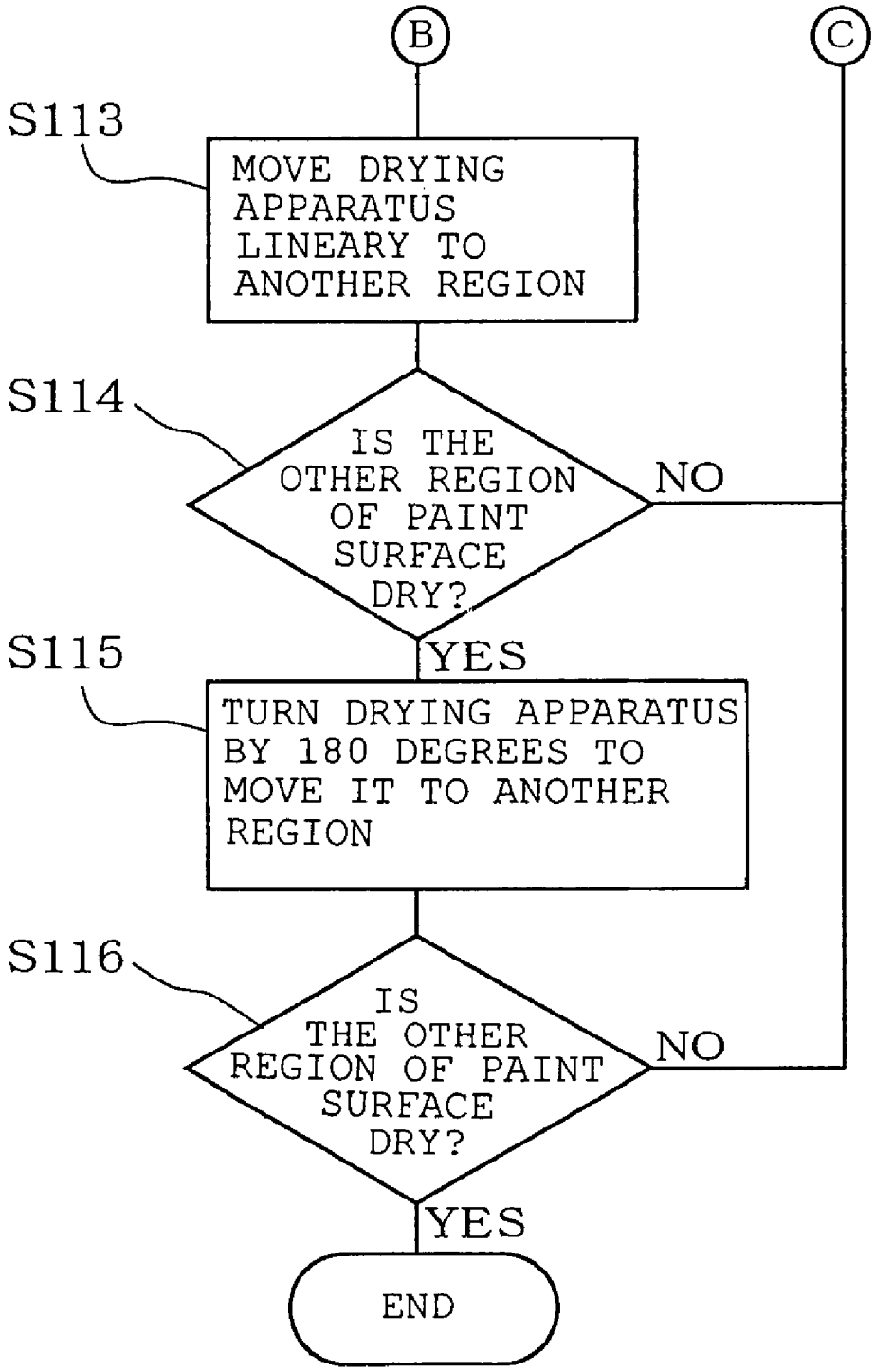
FIG. 13 is a flowchart illustrating a drying operation using a repair device for vehicle.
Figure 14:
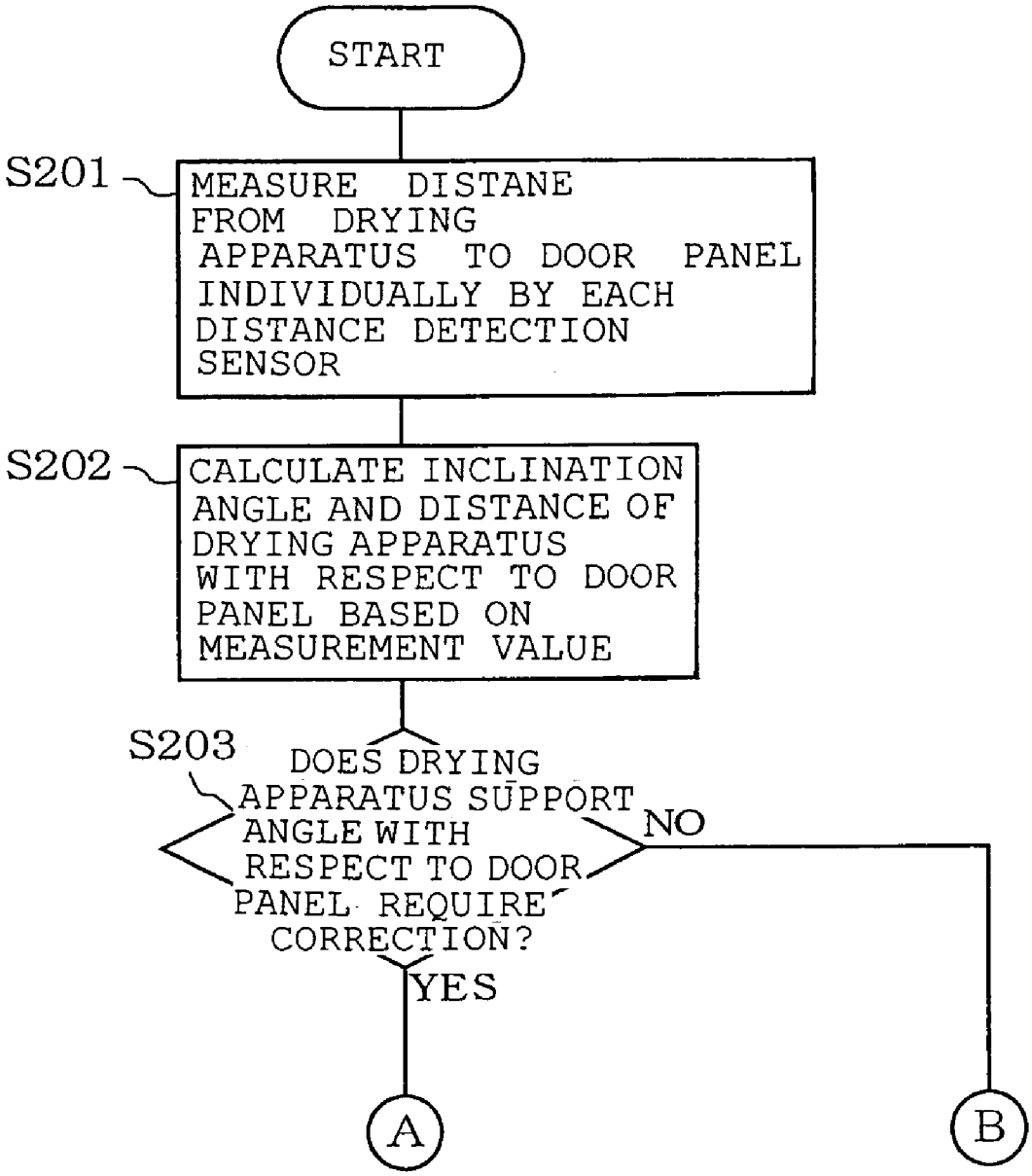
FIG. 14 is a flowchart related to control of a movable portion of a repair device for vehicle.
Figure 15:
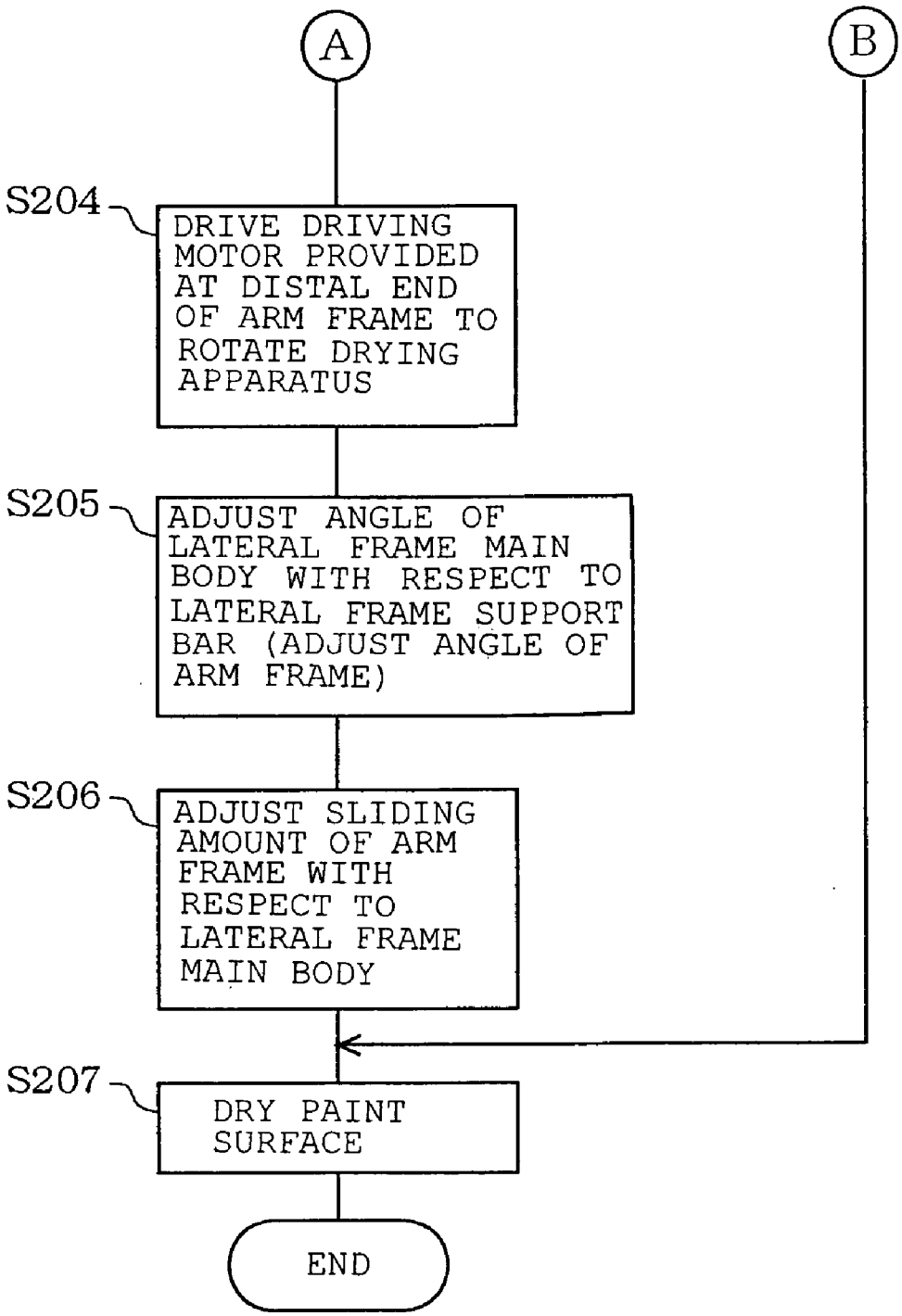
FIG. 15 is a flowchart related to control of a movable portion of a repair device for vehicle.
Figure 16:
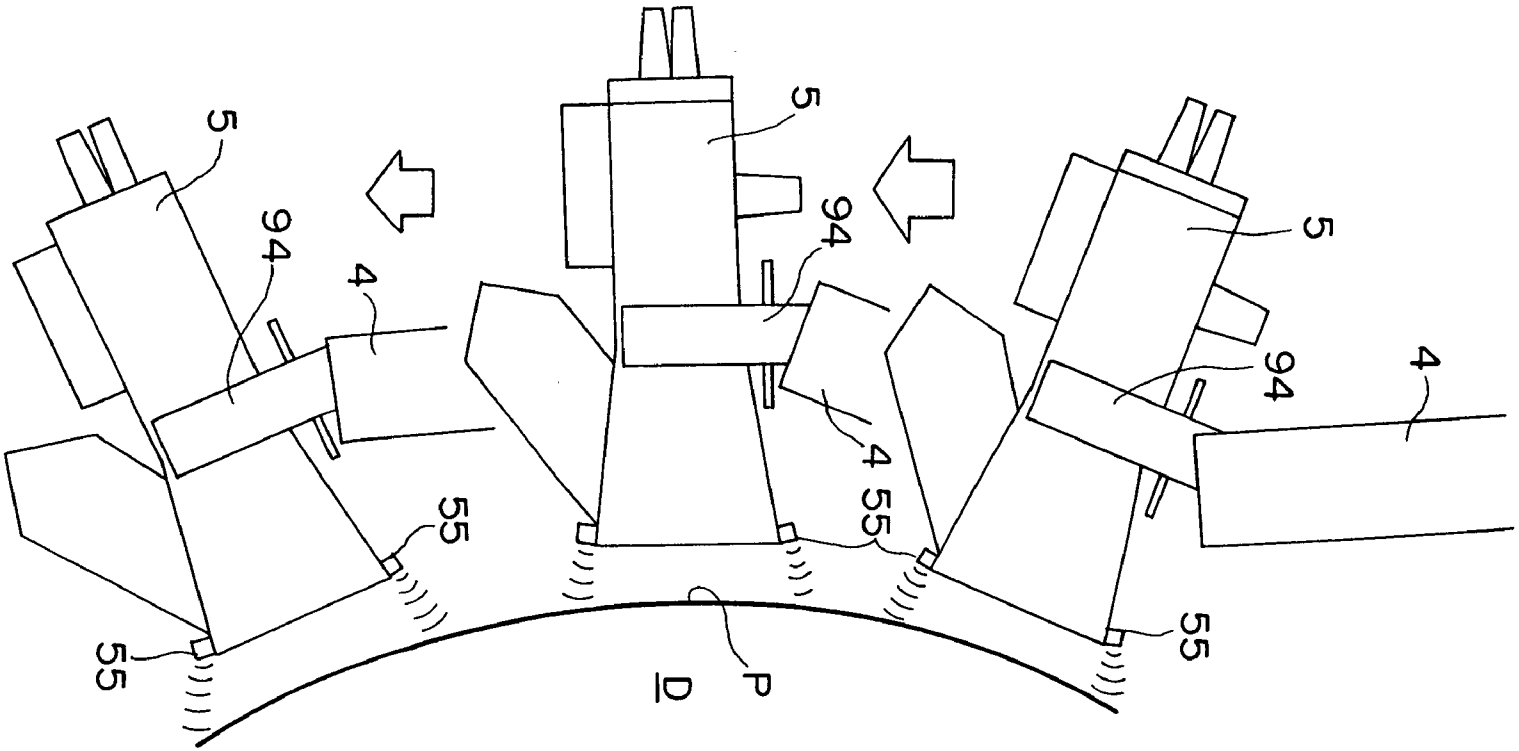
FIG. 16 is a diagram showing a support angle for a drying apparatus with respect to a paint surface.

In the following, the procedures for drying a paint applied to a door panel D by using the above-described repair device for vehicle, and an example of the control of each movable portion related to the above-mentioned automatic control will be described with reference to FIGS. 11 through 17. Note that in the following example, the door panel D consists of a door panel central portion of which is a convex panel. FIGS. 11 through 13 are flowcharts illustrating the progress of the painting operation, and FIGS. 14 and 15 are flowcharts illustrating the control of each movable portion.

First, after the application of the paint to the door panel D, the above-described repair device for vehicle is installed so as to face the door panel D (step 101). Subsequently, the operator manipulates the mode changing switch to effect switching to the manual mode, and manually controls each frame so that the drying apparatus 5 may be arranged near the right upper corner of the paint surface P to set the drying start point A (steps 102 and 103). Then, after the setting of the drying start point A, switching to the automatic mode is effected to place the support rack in the automatic control state (step 104). It should be noted that when arranging the drying apparatus near the corner of the paint surface P in the manual mode, there is no need to accurately adjust the inclination angle and distance of the drying apparatus 5 with respect to the paint surface P. It is only necessary for the drying apparatus to be situated near the corner of the paint surface P.

Then, the support rack 1 placed in the automatic control state moves each movable portion to change the fixation angle of the drying apparatus 5 such that the drying apparatus is arranged at an appropriate angle and distance with respect to the door panel D (step 105). And, in order to dry the paint applied to the door panel D, infrared rays and air warmed by the infrared rays are applied and blown from the drying apparatus 5 (step 106).

Meanwhile, the distance between the drying apparatus 5 and the paint surface P is constantly measured by the ultrasonic distance measuring sensor provided in the drying apparatus 5. Further, the amount (concentration) of solvent evaporated from the paint surface P is detected by the gas sensor to monitor the dryness of the paint surface P. And, a judgment is made as to whether the paint surface P has been dried or not on the basis of the value detected by the gas sensor. When it is determined that the paint surface P has been dried, the drying apparatus is linearly moved to another region (steps 107 and 108) Further when it is determined in step 107 that the paint surface P has not been dried yet, the control in step 106 is continued.

When moving the drying apparatus 5 to another region, a judgment is made by the distance detection sensors 55 as to whether or not there has been any change in the angle and distance of the drying apparatus 5 with respect to the door panel D (step 109). And, when there has been a change in the angle and distance with respect to the door panel D, each movable portion of the support rack is moved so as to adapt the drying apparatus to the change, effecting correction such that the drying apparatus is at an appropriate angle and distance with respect to the door panel D (step 110). Then, after correction has been effected in step 110 such that the drying apparatus 5 is at an appropriate angle and distance with respect to the door panel D, infrared rays and warm air are again applied and blown to the paint surface P to dry the same (step 111). Note that when in step 109 no change is to be found in the angle and distance of the drying apparatus 5 with respect to the door panel D, the procedure advances to step 111, where the paint surface P is dried.

Further, the control of each movable portion in step 110 is effected as follows. First, by using each distance detection sensor 55 provided on the drying apparatus 5, the distance from the paint surface P is individually measured (step 201). And, the detected values are compared in a change processing portion provided in the control box 7 to calculate the inclination angle and distance of the drying apparatus 5 with respect to the panel D (step 202).

Then, a judgment is made as to whether the support angle of the drying apparatus 5 is to be corrected or not (step 203). Here, when it is determined that correction is necessary, the driving motor 94 provided at the distal end of the arm frame 4 is driven to rotate the drying apparatus 5 so that the measurement values obtained by the distance detection sensors 55 may become the same (step 204). Further, the angle of the lateral frame main body 12 with respect to the lateral frame support bar 11 is adjusted such that the value obtained by each distance detection sensor 55 becomes a predetermined value, that is, the distance from the paint surface P to the drying apparatus 5 becomes a value suitable for drying (step 205). Further, the sliding amount of the arm frame 4 with respect to the lateral frame main body 12 is adjusted so as to maintain a fixed distance from the paint surface P to the drying apparatus 5 (step 206).

It should be noted that the above-mentioned control processes from steps 204 to 206 are changed in order as needed according to the correction to be performed on the drying apparatus 5 with respect to the paint surface P so that the correction on the drying apparatus 5 may be completed in a shorter time. Of course, in some cases, the control processes are performed simultaneously. And, while repeating these correction processes, the drying apparatus 5 is moved along the paint surface P to dry the paint surface P (step 207).

Further, in the other region, the dryness of the paint surface P is judged on the basis of the value obtained by the dryness detection sensor 56 (step 112). Then, when it is determined that the paint surface is dry, the drying apparatus 5 is linearly moved to another region (step 113). Further, when it is determined in step 112 that the paint surface has not been dried yet, the procedure returns to step 111 to continue the drying operation.

Then the drying apparatus 5 linearly moved to the other region makes a judgment as to whether the paint surface P is dry or not (step 114). Here, when it is determined that the paint surface is dry, a change of direction by 180 degrees is made as indicated by point X in FIG. 17, and the drying apparatus is moved to another region (step 115). And, in the other region, a judgment is made as to whether the paint surface P is dry or not (step 116). Then, when it is determined in step 116 that the paint surface is dry, it is regarded that drying completion point E is reached, thus completing the control. Further, when it is determined in step 114 that the paint surface has not been dried yet, it is concluded that there remains a portion of the paint surface P which has not been dried yet, and the procedure returns to step 109 to continue the drying operation.

Figure 17:
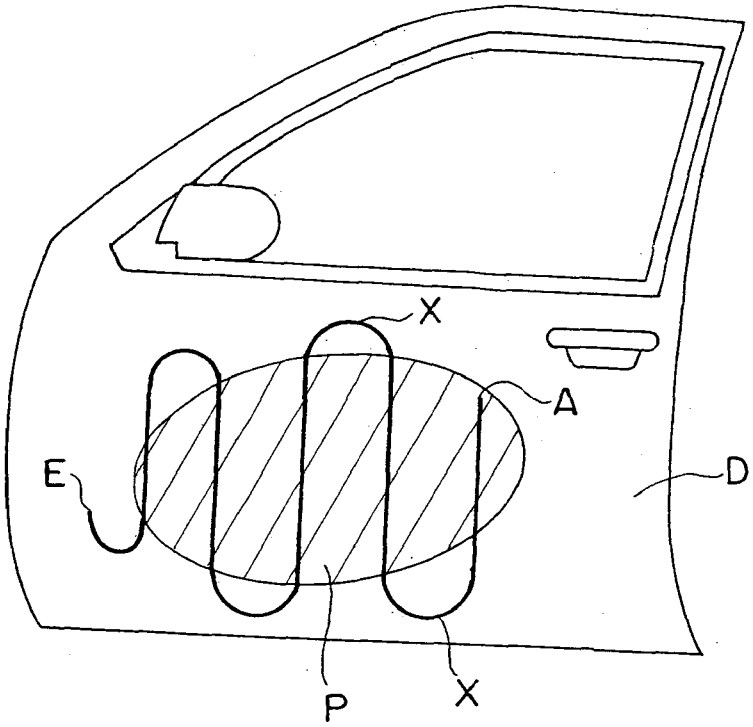
FIG. 17 is a diagram showing a locus of a drying apparatus with respect to a paint surface.

It should be noted that FIG. 17 shows a locus of the drying apparatus 5 with respect to the paint surface P. Further in the drawing, the shaded portion indicates the paint surface P. As shown in the drawing, the drying apparatus 5 first vertically descends from the vicinity of the right upper corner of the door panel D to dry that column region of the paint surface P. And, at a position further below the paint surface P, it makes a change of direction to ascend along the column region of the paint surface P which is on the left-hand side of the region of the paint surface P that has been dried, drying that column region of the paint surface P. And, at a position further above this column region of the paint surface P, it makes a change of direction again to descend. In this way, the paint surface P is successively dried starting from the right upper corner portion thereof.

Figure 18:
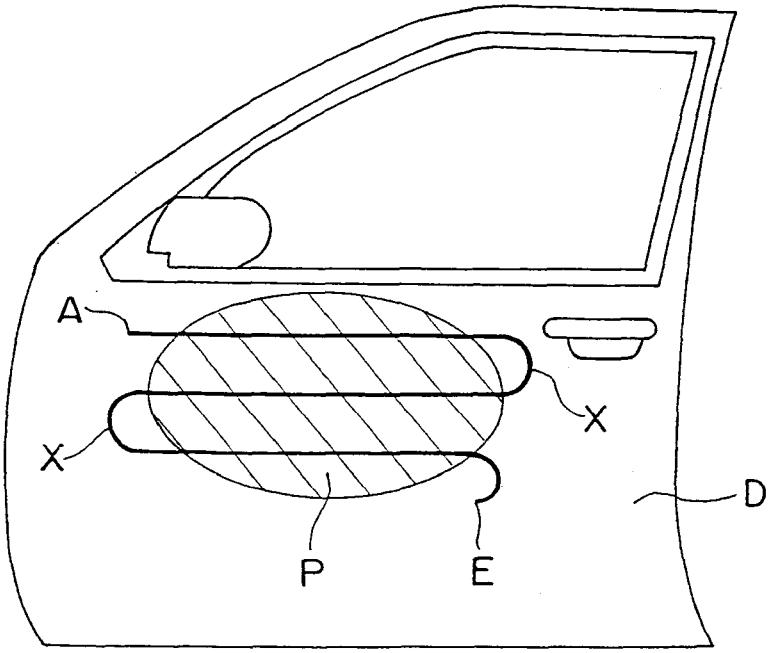
FIG. 18 is a diagram showing a locus of a drying apparatus with respect to a paint surface.

Note that the moving direction of the drying apparatus 5 at point X in FIG. 17, that is, the point where the drying apparatus turns over, is previously recorded on the control board in the control box, and on the basis of the data, the drying apparatus 5 is moved from the right to the left of the paint surface P. Further, regarding the data on the moving direction of the drying apparatus 5, it is also possible to perform control so as to move the drying apparatus from the upper to the lower portion of the paint surface P as shown in FIG. 18. Thus, the moving direction can be appropriately selected according to the configuration (expansion) of the paint surface P. And, the data on points X and E is determined on the basis of the data on the longitudinal and lateral sizes of the paint surface P inputted into the control box 7 by the operator and the data on point A at the time of initial setting.

In this way, on the basis of the values obtained by the sensors 55 and 56, automatic control is effected such that the drying apparatus 5 is always at such angle and distance that are suitable for drying with respect to the paint surface. Further, in proceeding with the drying operation, the dryness of the paint surface is constantly monitored by the dryness detection sensor, so that there is no need to control the requisite time for drying.

Note that while the above-described example of the repair device for vehicle consists of one suitable for a relatively wide and flat panel surface as in the case of the hood or door panel of a vehicle, it may also be a repair device for vehicle in which, for example, it may be one provided with the driving device such that the drying apparatus provided at the distal end of the arm frame is rotated around the axis of the arm frame. That is, the number of movable portions is not restricted to that of the above-described example.

Further, while in the above-described example the object of drying consists of a paint, it may also be a putty or the like containing solvent. Furthermore, when the object of drying consists of a putty, paint or the like containing an ultraviolet polymerization composite which cures by absorbing ultraviolet rays, ultraviolet rays are irradiated for drying from the ultraviolet-ray radiation portion provided in the drying apparatus.

Further, while in the above-described example the support rack constitutes the moving device, it may also be, for example, a moving device of a structure in which the drying apparatus is suspended from the ceiling of a workshop at a desired angle and so as to be capable of moving in all directions.

Further, while in the present invention each movable portion of the moving device is controlled on the basis of the values obtained by the distance detection sensors and the dryness detection sensor, it is naturally possible to utilize values obtained by the sensors in controlling the drying apparatus. For example, when the drying apparatus is away from the paint surface, the power of the blower is boosted so that more warm air may be blown against the paint surface. Further, when the drying apparatus comes too near the paint surface, the irradiation intensity of the infrared rays and ultraviolet rays is reduced. In this way, the above values can be used not only for the control of the moving device but also for the control of the drying apparatus. Thus, in the repair device for vehicle of the present invention, it is possible to maintain fixed drying conditions on the basis of the values obtained by the various sensors.

Furthermore, while in the above-described repair device for vehicle, the support rack is controlled on the basis of the values obtained by both the distance detection sensors and the dryness detection sensor, it is also possible to provide only the distance detection sensors on the repair device for vehicle, controlling the movement of the drying apparatus based on passage of a predetermined period of time. That is, while in the repair device for vehicle of this embodiment the drying apparatus is moved to another region after checking the dryness with the dryness detection sensor, it is also possible to control the drying apparatus and the support rack by providing a control device such as a timer which issues a control command so as to move the drying apparatus based on passage of time. Further, in the case in which only the dryness detection sensor is provided in the repair device for vehicle of the present invention, the operator can accurately ascertain the dryness of the paint surface on the basis of the value obtained by the dryness detection sensor, so that by controlling the support rack on the basis of the value obtained by the dryness detection sensor, it is possible to obtain a satisfactory paint surface.

INDUSTRIAL APPLICABILITY

The repair device of the present invention is particularly suitable as a repair device for drying a paint, putty or the like applied to a panel surface constituting the portion to be repaired. Further, the repair device of the present invention is applicable not only to vehicles but also to various uses, such as the repair of paint surfaces of furniture of the like and the repair of building wall surfaces.

What is claimed is:

1. A repair device for a vehicle comprising a drying apparatus for drying a coating material applied to a panel surface, a distance detection sensor provided on the drying apparatus and adapted to detect the distance from the drying apparatus to the panel surface to which the coating material is applied, and a moving device for moving the drying apparatus along the panel surface, wherein the moving device moves the drying apparatus along the panel surface such that the value detected by the distance detection sensor is a value within a predetermined range, wherein the moving device includes a longitudinal frame, a lateral frame provided so as to be slidable in the vertical direction of the longitudinal frame, and an arm frame which is provided so as to be slidable in the axial direction of the lateral frame and in a direction perpendicular to the axial direction and which is supported so as to be rotatable in the vertical direction thereof using the lateral frame as a rotation axis, and wherein the drying apparatus is provided at the distal end of the arm frame so as to be at a desired angle.

2. A repair device for a vehicle according to claim 1, wherein the drying apparatus is equipped with an infrared-ray irradiation device for applying infrared rays to the coating material applied to the panel surface, and a blower for blowing air warmed by the infrared rays of the infrared-ray irradiation device to the coating material applied to the panel surface.

3. A repair device for a vehicle according to claim 2, wherein the distance detection sensor has an oscillating portion emitting ultrasonic waves, a receiving portion for receiving the ultrasonic waves emitted from the oscillating portion, and a conversion processing portion for measuring the time it takes for the ultrasonic waves emitted from the oscillating portion to reach the receiving portion and converting the time into distance information.

4. A repair device for a vehicle according to claim 2, wherein the dryness detection sensor detects solvent evaporated into the air from the coating material when drying the coating material to thereby recognize the dryness of the coating material.

5. A repair device for a vehicle according to claim 2, wherein the drying apparatus is equipped with an ultraviolet-ray irradiation device for applying ultraviolet rays to the coating material applied to the panel surface.

6. A repair device for a vehicle according to claim 1, wherein the distance detection sensor has an oscillating portion emitting ultrasonic waves, a receiving portion for receiving the ultrasonic waves emitted from the oscillating portion, and a conversion processing portion for measuring the time it takes for the ultrasonic waves emitted from the oscillating portion to reach the receiving portion and converting the time into distance information.

7. A repair device for a vehicle according to claim 6, wherein the dryness detection sensor detects solvent evaporated into the air from the coating material when drying the coating material to thereby recognize the dryness of the coating material.

8. A repair device for a vehicle according to claim 6, wherein the drying apparatus is equipped with an ultraviolet-ray irradiation device for applying ultraviolet rays to the coating material applied to the panel surface.

9. A repair device for a vehicle according to claim 1, wherein the drying apparatus is equipped with an ultraviolet-ray irradiation device for applying ultraviolet rays to the coating material applied to the panel surface.

10. A repair device for a vehicle according to claim 1, wherein the dryness detection sensor detects solvent evaporated into the air from the coating material when drying the coating material to thereby recognize the dryness of the coating material.

11. A repair device for a vehicle comprising a drying apparatus for drying a coating material applied to a panel surface, a dryness detection sensor for detecting the dryness of the coating material applied to the panel surface, and a moving device for moving the drying apparatus to another region of the panel surface when it is determined by the dryness detection sensor that the panel surface is dry.

12. A repair device for a vehicle according to claim 11, wherein the dryness detection sensor detects solvent evaporated into the air from the coating material when drying the coating material to thereby recognize the dryness of the coating material.

13. A repair device for a vehicle according to claim 12, wherein the drying apparatus is equipped with an ultraviolet-ray irradiation device for applying ultraviolet rays to the coating material applied to the panel surface.

14. A repair device for a vehicle according to claim 11, wherein the moving device includes a longitudinal frame, a lateral frame provided so as to be slidable in the vertical direction of the longitudinal frame, and an arm frame which is provided so as to be slidable in the axial direction of the lateral frame and in a direction perpendicular to the axial direction and which is supported so as to be rotatable in the vertical direction thereof using the lateral frame as a rotation axis, and wherein the drying apparatus is provided at the distal end of the arm frame so as to be at a desired angle.

15. A repair device for a vehicle according to claim 11, wherein the drying apparatus is equipped with an infrared-ray irradiation device for applying infrared rays to the coating material applied to the panel surface, and a blower for blowing air warmed by the infrared rays of the infrared-ray irradiation device to the coating material applied to the panel surface.

16. A repair device for a vehicle according to claim 11, wherein the drying apparatus is equipped with an ultraviolet-ray irradiation device for applying ultraviolet rays to the coating material applied to the panel surface.

* * * * *

UNITED STATES PATENT AND TRADEMARK OFFICE

CERTIFICATE OF CORRECTION

PATENT NO. : 6,731,866 B2
DATED : May 4, 2004
INVENTOR(S) : Makoto Ueno

It is certified that error appears in the above-identified patent and that said Letters Patent is hereby corrected as shown below:

Title page,
Item [73], Assignee, "Senda" should be -- Sendai --.

Signed and Sealed this

Twenty-first Day of September, 2004

JON W. DUDAS
*Director of the United States Patent and Trademark Office*